US009327878B2

(12) United States Patent
Schueller et al.

(10) Patent No.: US 9,327,878 B2
(45) Date of Patent: May 3, 2016

(54) SCREW CLOSURE HAVING A SECURITY RING AND METHOD FOR PROVIDING A CONTAINER HAVING A SCREW CLOSURE

(75) Inventors: Franz-Peter Schueller, Dormagen (DE); Wulf Schormair, Singapur (SG)

(73) Assignee: Bayer Intellectual Property GmbH, Monheim am Rhein (DE)

( * ) Notice: Subject to any disclaimer, the term of this patent is extended or adjusted under 35 U.S.C. 154(b) by 205 days.

(21) Appl. No.: 13/138,295

(22) PCT Filed: Jan. 29, 2010

(86) PCT No.: PCT/EP2010/000536

§ 371 (c)(1),
(2), (4) Date: Jul. 28, 2011

(87) PCT Pub. No.: WO2010/086171

PCT Pub. Date: Aug. 5, 2010

(65) Prior Publication Data

US 2011/0278299 A1 Nov. 17, 2011

(30) Foreign Application Priority Data

Jan. 29, 2009 (DE) ..... 10 2009 006 614

(51) Int. Cl.
*B65D 41/02* (2006.01)
*B65D 51/00* (2006.01)
(Continued)

(52) U.S. Cl.
CPC ..... *B65D 41/3428* (2013.01); *B65D 55/06* (2013.01)

(58) Field of Classification Search
CPC ..... B65D 41/3447; B65D 41/3428; B65D 41/3452; B01L 2200/141; B01L 2031/56
USPC ..... 220/265–277; 215/250–258, 206
See application file for complete search history.

(56) References Cited

U.S. PATENT DOCUMENTS 3,904,062 A * 9/1975 Grussen ..... 215/252
3,957,169 A * 5/1976 Coursaut ..... 215/253
(Continued)

FOREIGN PATENT DOCUMENTS

DE 2643068 5/1977
DE 2753239 6/1979
(Continued)

OTHER PUBLICATIONS

English Abstract of DE602004000119.
(Continued)

*Primary Examiner* — Shawn M Braden
(74) *Attorney, Agent, or Firm* — Dykema Gossett PLLC

(57) ABSTRACT

A screw closure (1) and a security ring (2) for closing an opening of a container, the screw closure (1) being connected to the security ring (2) by way of breakable bridge elements (4), the screw closure having an internal thread (6) for screwing onto an external thread on the opening of the container. The security ring (2) includes latching means which are intended to engage behind a bead on the opening of the container such that, when the screw closure (1) is unscrewed for the first time, the bridging elements (4) break and the screw closure (1) and the security ring (2) are separated from one another. A security seal (13) is provided on the screw closure (1) and the security ring (2) and is damaged when unscrewing takes place for the first time. The security seal can be attached to the screw closure and security ring in a separate operation from the filling and closing of the container.

7 Claims, 1 Drawing Sheet

(51) Int. Cl.
*B65D 41/34* (2006.01)
*B65D 55/06* (2006.01)

(56) References Cited

U.S. PATENT DOCUMENTS

| | | | | | |
|---|---|---|---|---|---|
| 4,449,639 | A * | 5/1984 | Davis | | 215/224 |
| 4,597,500 | A * | 7/1986 | Stubbs | | 215/256 |
| 4,706,828 | A * | 11/1987 | Zinnbauer | | 215/246 |
| 4,967,920 | A * | 11/1990 | Dahl | | 215/252 |
| 4,998,988 | A * | 3/1991 | Zinnbauer | | 215/230 |
| 5,207,783 | A * | 5/1993 | Burton | | 215/256 |
| 5,373,954 | A * | 12/1994 | Julian | B65D 41/3409 | 215/252 |
| 5,875,908 | A * | 3/1999 | Witt et al. | | 215/256 |
| 5,979,681 | A * | 11/1999 | Varlet et al. | | 215/216 |
| 6,254,139 | B1 * | 7/2001 | Fresnel | | 283/94 |
| 6,968,966 | B2 * | 11/2005 | Gregory | | 215/252 |
| 2004/0150221 | A1 | 8/2004 | Brown | | |
| 2005/0035081 | A1 | 2/2005 | Fitch | | |

FOREIGN PATENT DOCUMENTS

| | | |
|---|---|---|
| DE | 3015014 | 11/1980 |
| DE | 9420052 | 3/1995 |
| DE | 60200400119 | 7/2006 |
| EP | 0352962 | 1/1990 |
| FR | 2607784 | 6/1988 |
| FR | 2739611 | 4/1997 |

OTHER PUBLICATIONS

English Abstract of FR2607784.
English Abstract of FR2739611.

* cited by examiner

SCREW CLOSURE HAVING A SECURITY RING AND METHOD FOR PROVIDING A CONTAINER HAVING A SCREW CLOSURE

BACKGROUND OF THE INVENTION

Field of the Invention

The invention relates to a screw closure having a security ring for closing an opening of a container. The invention furthermore relates to a method for providing a container having a screw closure.

DE 602 004 000 119 T2 discloses a screw closure which is connected to a security ring by way of breakable bridging elements and which includes an internal thread for screwing onto an external thread located on the opening of a container. The security ring has in this case latching means which are intended to engage behind a bead on the opening of the container such that, when the screw closure is unscrewed for the first time, the bridging elements break and the screw closure and the security ring are separated from one another. A security ring separated from the screw closure indicates that the screw closure has already been unscrewed at least once and some of the product may have been removed from the container. A separated security ring is therefore a clear sign that the screw closure has previously been unscrewed. The security ring is also intended to increase the resistance when unscrewing the screw closure for the first time so that the latter cannot unintentionally be loosened.

It is furthermore known to provide a security seal to make it more difficult to tamper with the product (for example a liquid or free-flowing crop protection agent) contained in the container. The security seal has in this case the form of a long strip which is guided over the screw closure and secured (e.g., adhesively bonded) at both ends to the container, When the container is opened for the first time, that is to say, when the screw closure is unscrewed, the strip form security seal is damaged.

The strip-form security seal is secured to the screw closure and the container after the container has been filled with the product. Consequently, the security seal is secured to the container at the filling location, or the container has to be transported with the screw closure screwed on to the location where the security seal is attached, which however increases the logistical effort.

It is therefore an object of the invention to provide a screw closure which enables simple production and handling of a tamperproof unit consisting of a container and a screw closure. It is also an object of the invention to provide, in a simple and secure manner, a tamperproof container having a screw closure.

SUMMARY OF THE INVENTION

According to the invention, the security seal is provided on the screw closure and the security ring such that it is damaged when unscrewing takes place for the first time. The security seal and the screw closure having the security ring form in this case a unit, the provision of which can be separated completely from filling the container with the product. The security seal does not extend beyond a lower edge of the security ring. Accordingly, the security seal may be attached to the screw closure and the security ring without any overlap, this making it harder to unintentionally detach the security seal from the screw closure and the security ring. A security seal attached with no overlap also makes it easier to handle the screw closure with the security ring, since there is no risk of the security seal breaking or bending at the overlap.

The security seal may comprise at least one layer of a material which is secured (for example by adhesive bonding or welding) to the screw closure and security ring. Alternatively, or in addition, it may comprise structures (for example recesses in the material or else elevations) which are introduced into the screw closure and/or the security ring. These structures can be embossed or else be already provided during the production of the screw closure, for example by an appropriate injection mould if the screw closure is an injection moulding made of plastic.

According to claim 1, the security seal is provided on the screw closure and the security ring such that it is damaged when unscrewing takes place for the first time. The security seal and the screw closure having the security ring form in this case a unit, the provision of which can be separated completely from filling the container with the product. The security seal does not extend beyond a lower edge of the security ring. Accordingly, the security seal may be attached to the screw closure and the security ring without any overlap, this making it harder to unintentionally detach the security seal from the screw closure and the security ring. A security seal attached with no overlap also makes it easier to handle the screw closure with the security ring, since there is no risk of the security seal breaking or bending at the overlap.

The security seal may comprise at least one layer or a material which is secured (for example by adhesive bonding or welding) to the screw closure and security ring. Alternatively, or in addition, it may comprise structures (for example recesses in the material or else elevations) which are introduced into the screw closure and/or the security ring. These structures can be embossed or else be already provided during the production of the screw closure, for example by an appropriate injection mould if the screw closure is an injection moulding made of plastic.

The structures are expediently formed such that they co-determine the appearance of the security seal. Simple roughening of the surface in order to achieve improved adhesion between the security seal and the screw closure during adhesive bonding is not intended to fall under the term "structures" in this preferred exemplary embodiment.

The embossed or otherwise formed structures can be combined as desired with other colours or materials in order to produce the security seal. By way of example, the security seal could comprise colour or ink which is applied to (for example stamped onto) the screw closure and/or the security ring. The colour applied can in the process cover the introduced structures so that, for example, a recess is covered precisely by a correspondingly formed coloured region in order to enhance the visual impression of the recess. Similarly, the introduced structures could also interact with an additional layer in order to form the security seal. It goes without saying that the stamping or direct application of colour even without the structures represents a possible embodiment of the invention.

The screw closure may be in the form of a one-part, two-part or multi-part screw cap. By way of example, the screw cap may comprise a snapped-in latching ring.

In a preferred exemplary embodiment, the underside of the security seal bears against an external lateral surface of the screw closure and against an external lateral surface of the security ring. As a result, the user of the product can ascertain at a glance whether a security seal is present and, if so, whether it has already been damaged or not. By means of the clearly visible security seal, it is thus possible to distinguish easily between a product which is intact and a product which has been tampered with.

A lower edge of the security seal may terminate approximately flush with the lower edge of the security ring. The flush termination with the security ring implies optimal use of the space available for the security seal.

In a preferred exemplary embodiment, the security seal has an approximately rectangular basic form having two longer edges and two shorter edges, one of the longer edges constituting the lower edge. This means that the security seal thus also extends in the direction of the parting line in the circumferential direction of the screw closure and the security ring, said parting line usually running along the circumference of the security ring. With such an alignment of the security seal, the resistance on unscrewing the screw closure for the first time is increased, such that there is a distinctly noticeable difference between unscrewing the screw closure for the first time and unscrewing it again. It should be noted that the security seal may assume any basic form (e.g. circular, elliptical). The security seal may extend over part of the circumference of the screw closure and the security ring or over the entire circumference thereof.

Preferably, the security seal has a predetermined breaking line. When unscrewing the screw closure and thus separating the screw closure and the security ring, the security seal, which is adhesively attached or secured both to the screw closure and to the security ring, tears along a defined line. As a result, it can be largely ruled out when unscrewing the screw closure that the security seal will remain undamaged if it comes away from the screw closure and the security ring owing to insufficient bonding and can thus be reused. The predetermined breaking line may be straight or wavy or have some other form (e.g. a grid).

The security seal or security tag may have a multilayer construction. For example, the underside may consist of a particularly strong adhesive so that it is not possible to detach the security seal from the screw closure and the security ring or it is only possible by incurring damage to the security seal. The multilayer nature of the security seal also makes it even more difficult to counterfeit the latter.

The security seal may have a hologram which is preferably partly only visible under artificial light (e.g. UV light). Furthermore, other features which can only be counterfeited with difficulty and/or can only be made visible using special instruments (e.g. induction) may be provided.

The latching means of the security ring may comprise an annular latching tab which is provided on the lower edge of the security ring and automatically engages in a latching manner behind the bead on the opening of the container when screwing on takes place for the first time. The latching tab and the bead on the opening of the container preferably then cooperate such that the security ring can no longer be removed from the container without destroying it.

The screw closure with the security ring and the security seal attached to the screw closure and the security ring form a tamperproof unit with a container which is closed by the screw closure. By way of example, a free-flowing or liquid crop protection agent could be filled in the container, the screw closure according to the invention making it difficult to tamper with said crop protection agent.

The security seal is attached to the screw closure before the screw closure is screwed onto the container. In this case, the screw closure can have features as described above.

The security seal can therefore be attached to the screw closure and the security ring even before the container is filled with the product. It is no longer necessary to keep machines or the like for attaching the security seal at the filling location. Accordingly, the attachment of the security seal and the first screwing-on of the screw closure onto the container can be separated spatially from one another. The expression "spatial separation" is to be understood here to mean that the attachment of the security seal on the one hand and the filling of the container and the subsequent screwing together on the other hand necessitate transportation of the screw closure between two completely separate operating/filling stations.

It is also much simpler to transport the screw closure and the security ring with the security seal secured/attached thereto than to transport the filled container. The solution according to the invention thus enables the technology of attaching the security seal and that of filling the product to be separate from one another without thereby increasing the logistical effort. This has the advantage that the tamperproof screw closure having the possibly very complicated security seal can be provided centrally or only at a few locations, it then being easier at these few locations to comply with safety precautions to be complied with. The filling of the containers and the screwing-on of the screw closure, which are separate from the provision of the screw closure, can then take place at many locations, at which it may be more difficult to comply with and monitor safety precautions. For example, the provision of the screw closures with security seals could take place at a plant belonging to a company in Germany. These finished units can then be dispatched around the world, where they can be screwed in the respective foreign country onto the containers that have been filled abroad. Thus, it is not necessary to be concerned that security seals, which, although provided for screw closures, have not yet been applied thereto, will be misused abroad.

BRIEF DESCRIPTION OF THE DRAWINGS

The invention is explained in more detail by way of the exemplary embodiments illustrated in the drawings, in which.

DETAILED DESCRIPTION OF THE PREFERRED EMBODIMENTS

Figure 1:
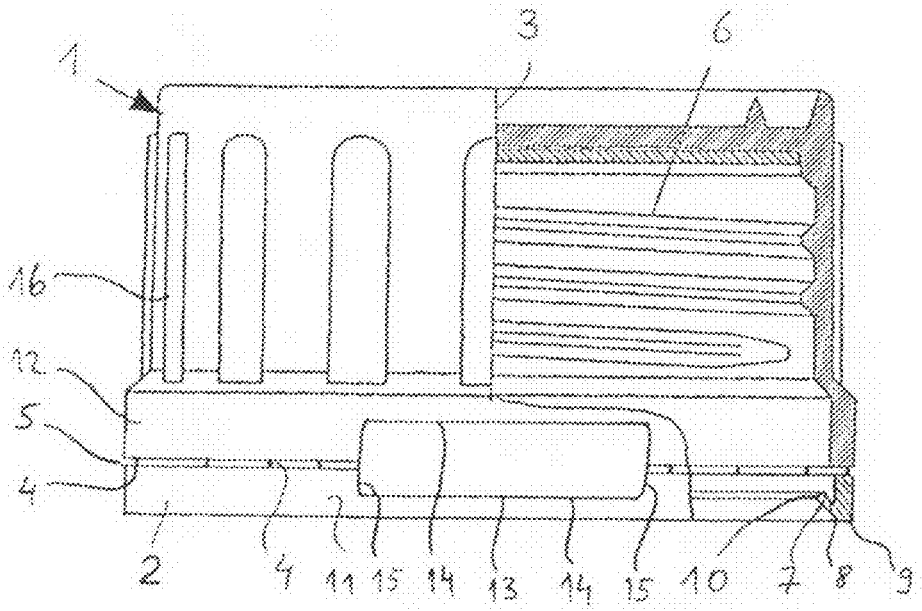
FIG. 1 shows a first embodiment of a screw closure with a security ring according to the invention.

FIG. 1 shows a screw closure 1 with a security ring 2. The screw closure 1 and the security ring 2 are shown in partial section. The screw closure 1 and the security ring 2 are essentially constructed so as to be rotationally symmetrical about a central axis 3.

A connection between the screw closure 1 and the security ring 2 is produced by a plurality of bridging elements 4 in the form of small webs. The bridging elements 4 in this case bridge a parting line 5 which extends in the circumferential direction of the screw closure 1 or the security ring 2, i.e., perpendicular to the central axis 3.

The screw closure 1 has an internal thread 6 so that it can be screwed onto the threaded opening of a container.

The security ring 2 has an annular latching tab 7 which is secured by a fixed end 8 on the lower rim or on a lower edge 9 of the security ring 2. When the screw closure 1 and the security ring 2 are screwed on for the first time, the screw closure is screwed on to such an extent that the latching tab 7 passes a bead on the opening of the container. In the process, a moveable end 10 of the latching tab 7 is pressed towards the circumference of the security ring in order then to latch automatically into a latching recess on the bead (not shown). The annular latching tab 7 is designed such that the security ring can no longer be pushed over the bead in the axial direction (i.e. towards the central axis 3). The security ring 2 is consequently secured firmly to the container.

A panel-like security seal with the reference 13 is adhesively bonded on an external lateral surface 11 of the security ring 2 and on an external lateral surface 12 of the screw closure 1. The security seal 13 is in this case approximately rectangular and has two longer edges 14 and two shorter edges 15. The longer edges 14 extend in this case parallel to the lower edge 9 of the security ring 2 or parallel to the parting line 5. The security seal 13 is in this case secured both to the external lateral surface 12 of the screw closure 1 and to the external lateral surface 11 of the security ring 2 and covers part of the parting line 5. If the screw closure 1 is then unscrewed from the container for the first time, the screw closure 1 and the security ring 2 fixed in the axial direction by the latching tab 7 are separated from one another, with the consequence that the security seal 13 is damaged. Part of the security seal 13 remains on the screw closure 1 while the other part remains bonded to the security ring 2.

The screw closure 1 has axially-extending webs 16 in the upper region, these webs being uniformly spaced apart from one another around the circumference. These webs increase the grip of the screw closure 1 in the direction of rotation.

Figure 2:
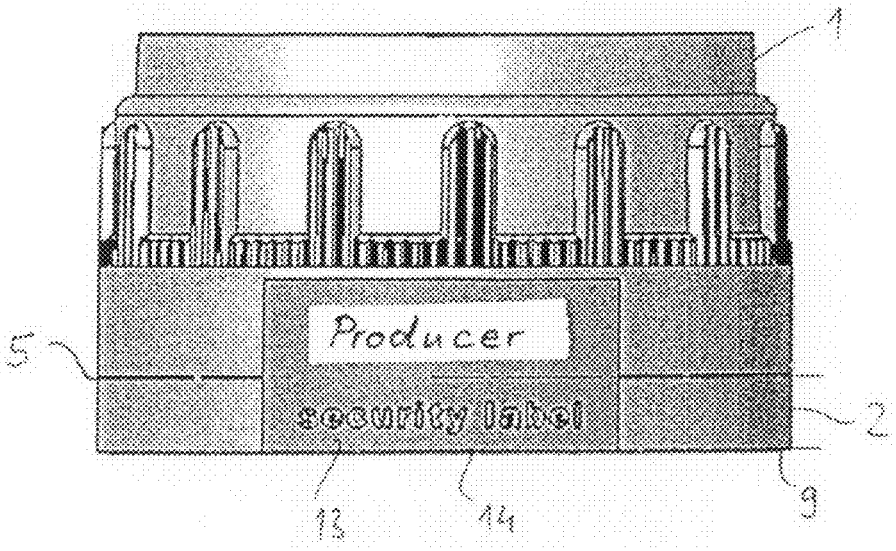
FIG. 2 shows a second embodiment of the screw closure according to the invention.

FIG. 2 shows a further exemplary embodiment of the screw closure 1 with the security ring 2. Features or components of this exemplary embodiment which are similar or identical to features or components of the exemplary embodiment of FIG. 1 have the same reference numerals in this case.

The lower longer edge 14 of the security seal 13 is in this case coincident with the lower edge 9 of the security ring 2. The security seal 13 thus terminates flush with the security ring 2. The axial height of the security ring 2 can thus be used optimally for applying a large security seal 13.

The security seal 13 may show different information. For example, it may indicate the original manufacturer of the product in the container. Furthermore, it may have different security features, which are not, however, illustrated in FIG. 1 and FIG. 2. For example, it could have a hologram which can only be copied with difficulty. Furthermore, it may have features which are only visible under artificial light or which can be detected only under particular boundary conditions.

LIST OF REFERENCE NUMERALS

1 Screw closure
2 Security ring
3 Central axis
4 Bridging element
5 Parting line
6 Internal thread
7 Latching tab
8 Fixed end
9 Lower edge
10 Moveable end
11 External lateral surface
12 External lateral surface
13 Security seal
14 Longer edge
15 Shorter edge
16 Web

The invention claimed is:

1. A combination of a one-piece screw closure and a security ring for dosing an opening of a container, the screw closure being connected to the security ring by way of breakable bridging elements and the screw closure being one piece with an internal thread for screwing onto an external thread on the opening of the container, the security ring having latching means which are intended to engage behind a bead on the opening of the container and break when the screw closure is unscrewed for the first time and becomes separated from the security ring, and including a security seal which extends outwardly of and between the screw closure and the security ring and which becomes damaged when the screw closure and security ring are separated, the security seal having an approximately rectangular basic form with two longer edges and two shorter edges, the longer edges extending parallel to the lower edge of the security ring and not extending beyond a lower edge of the security ring, the security seal being formed of material having structures including at least one of depressions and raised portions, and including an ink in register with the structures, said ink having a color which differs from a color of the screw closure and the security ring so that a visual impression of the structures is enhanced.

2. The combination according to claim 1, wherein an underside of the security seal bears against an extern& lateral surface of the screw closure and against an external lateral surface of the security ring.

3. The combination according to claim 1, wherein the security seal terminates approximately flush with a lower edge of the security ring.

4. The combination according to claim 1, wherein the security seal has a predetermined breaking line, the predetermined breaking line is wavy or in the form of a grid.

5. The combination according to claim 1, wherein the security seal has a multilayer construction.

6. The combination according to claim 1, wherein the security seal has features which are only visible under artificial light or can only be made visible using other instruments.

7. The combination according to claim 1, wherein the latching means comprise an annular latching tab which is provided on a lower edge of the security ring and automatically engages in a latching manner behind the bead on the opening of the container when screwed on.

* * * * *

UNITED STATES PATENT AND TRADEMARK OFFICE

CERTIFICATE OF CORRECTION

PATENT NO. : 9,327,878 B2
APPLICATION NO. : 13/138295
DATED : May 3, 2016
INVENTOR(S) : Schueller et al.

It is certified that error appears in the above-identified patent and that said Letters Patent is hereby corrected as shown below:

In the Claims

Claim 1, line 2, replace the term “dosing” with --closing--.

Claim 2, line 2, replace the term “extern&” with --external--.

Signed and Sealed this
Twenty-eighth Day of June, 2016

Michelle K. Lee

Michelle K. Lee
*Director of the United States Patent and Trademark Office*